US011062857B2

(12) United States Patent
Nordman et al.

(10) Patent No.: US 11,062,857 B2
(45) Date of Patent: Jul. 13, 2021

(54) SWITCHING DEVICE

(71) Applicant: ABB Schweiz AG, Baden (CH)

(72) Inventors: Andre Nordman, Vaasa (FI); Benjamin Lehmann, Vaasa (FI); Juha-Matti Rajala, Vaasa (FI)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/847,868

(22) Filed: Apr. 14, 2020

(65) Prior Publication Data

US 2020/0335286 A1 Oct. 22, 2020

(30) Foreign Application Priority Data

Apr. 18, 2019 (EP) ..... 19170115

(51) Int. Cl.

| | |
|---|---|
| ***H01H 1/14*** | (2006.01) |
| ***H01H 1/50*** | (2006.01) |
| ***H01H 3/46*** | (2006.01) |
| ***H01H 85/20*** | (2006.01) |
| ***H01H 89/04*** | (2006.01) |

(52) U.S. Cl.

CPC ..... *H01H 3/46* (2013.01); *H01H 1/14* (2013.01); *H01H 1/50* (2013.01); *H01H 85/20* (2013.01); *H01H 89/04* (2013.01)

(58) Field of Classification Search

CPC ..... H01H 1/14; H01H 1/50; H01H 1/2041; H01H 9/10; H01H 9/32; H01H 33/045; H01H 33/08; H01H 3/46; H01H 79/00; H01H 85/20; H01H 89/04; H01H 1/36; H01H 1/42

USPC ..... 200/570, 243, 244, 254, 255, 273, 277

See application file for complete search history.

(56) References Cited

U.S. PATENT DOCUMENTS

| | | | | |
|---|---|---|---|---|
| 3,917,920 | A * | 11/1975 | Pekrul | H01H 1/365 200/571 |
| 4,127,757 | A * | 11/1978 | Kylmanen | H01H 1/54 200/254 |
| 5,319,167 | A | 6/1994 | Juds et al. | |
| 9,299,509 | B2 * | 3/2016 | Coquil | H01H 1/2041 |
| 9,734,958 | B2 * | 8/2017 | Huβmann | H01H 1/42 |
| 9,824,830 | B2 * | 11/2017 | Ness | H01H 1/36 |
| 2015/0090696 | A1 | 4/2015 | Mattlar et al. | |

(Continued)

OTHER PUBLICATIONS

European Patent Office, Extended Search Report issued in corresponding Application No. 19170115.0, dated Nov. 14, 2019, 8 pp.

*Primary Examiner* — William A Bolton

(74) *Attorney, Agent, or Firm* — Taft Stettinius & Hollister LLP

(57) ABSTRACT

A switching device including a frame, a first fixed contact member having a first contact area, and a first movable contact member having a first contact arm provided with a contact area. The first movable contact member is adapted to pivot relative to the frame around a first pivoting axis between a first position and a second position. The switching device includes a spreader member that is adapted to provide a first intermediate position for the first movable contact member in which a projection of the contact area of the first contact arm overlaps at least partially with a projection of the first contact area on a switch plane perpendicular to the first pivoting axis while the contact area of the first contact arm is spaced apart from the first contact area.

17 Claims, 6 Drawing Sheets

(56) References Cited

U.S. PATENT DOCUMENTS

2015/0287551 A1* 10/2015 Uitto ..... H01H 1/2041
200/243
2016/0099120 A1* 4/2016 Valivainio ..... H01H 1/365
200/570

* cited by examiner

SWITCHING DEVICE

FIELD OF THE INVENTION

The present invention relates to a blade contact switching device according to the preamble of the independent claim 1. Herein a blade contact switching device is a device having a fixed contact and a movable contact adapted to pivot around a pivoting axis such that in the closed state of the switching device, projections of contact areas of the fixed contact and movable contact overlap on a plane perpendicular to the pivoting axis.

One of the problems associated with a blade contact switching device is that during a closing operation a mutual contact area between the fixed contact and the movable contact increases gradually as the movable contact pivots towards the position thereof corresponding to the closed state of the blade contact switching device. The gradual increase of the mutual contact area is a disadvantageous property for short circuit performance of the blade contact switching device since during a closing event a short circuit current may destroy the fixed contact and the movable contact before the mutual contact area reaches its maximum value.

BRIEF DESCRIPTION OF THE INVENTION

An object of the present invention is to provide a switching device with improved short circuit performance.

The objects of the invention are achieved by a switching device which is characterized by what is stated in the independent claim. The preferred embodiments of the invention are disclosed in the dependent claims.

The invention is based on the idea of providing a switching device with a spreader member that is adapted to move a movable contact member in a lateral direction away from a fixed contact member such that during a closing event of the switching device the spreader member allows the movable contact member to contact the fixed contact member only after the movable contact member has pivoted to a position in which the contact area of the movable contact member overlaps at least partially with the contact area of the fixed contact member, wherein the lateral direction is a direction parallel to the pivoting axis of the movable contact member.

An advantage of the switching device according to present invention is its improved short circuit performance. The mutual contact area between the fixed contact and the movable contact increases faster than in a corresponding known switching device, thereby enabling the switching device to withstand larger short circuit current in connection with the closing event.

BRIEF DESCRIPTION OF THE DRAWINGS

In the following the invention will be described in greater detail by means of preferred embodiments with reference to the attached drawings, in which.

DETAILED DESCRIPTION OF THE INVENTION

Figure 1:
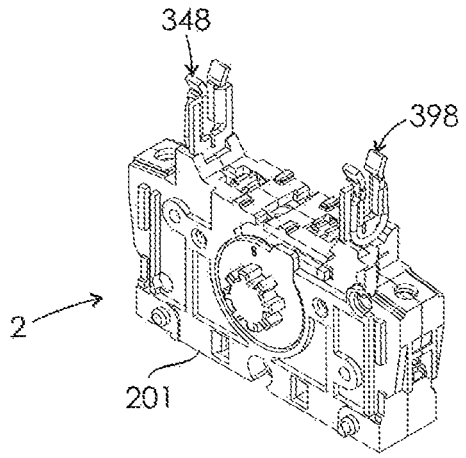
FIG. 1 shows a switching device according to an embodiment of present invention.
Figure 2:
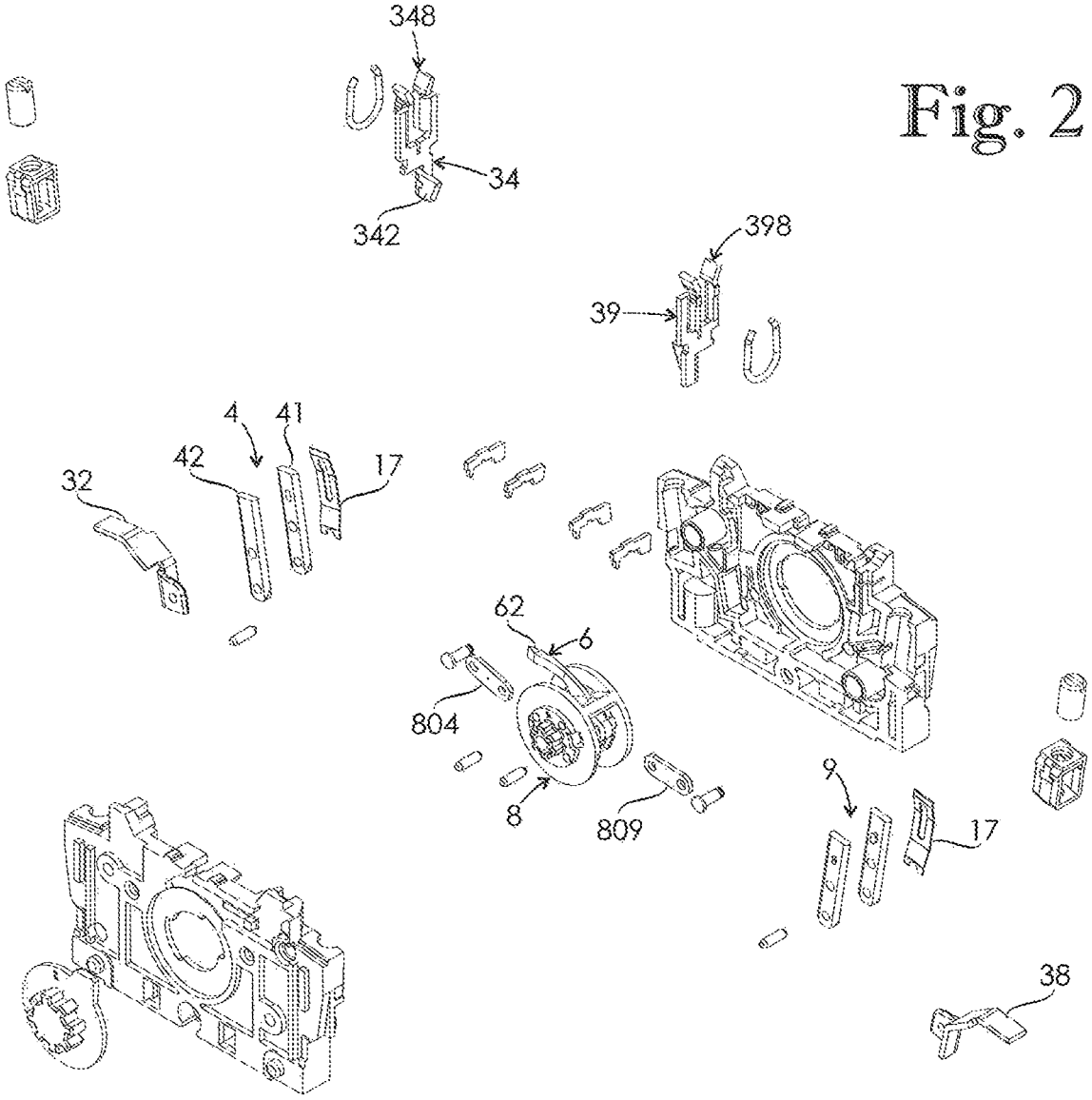
FIG. 2 shows an exploded view of the switching device of FIG. 1.

FIG. 1 shows a switching device 2 according to an embodiment of present invention. FIG. 2 shows an exploded view of the switching device 2 of FIG. 1.

The switching device 2 comprises a frame 201, a load terminal 32 adapted to be connected to a load, a supply terminal 38 adapted to be connected to a power supply, a first fixed contact member 34, a second fixed contact member 39, a first movable contact member 4, a second movable contact member 9, a first spring system comprising two contact springs 17, an actuator roll 8 and a spreader member 6. The load terminal 32, the supply terminal 38, the first fixed contact member 34 and the second fixed contact member 39 are stationary members relative to the frame 201.

The first movable contact member 4 has a first contact arm 41 provided with a contact area, and a second contact arm 42 provided with a contact area. The first fixed contact member 34 has a first contact area 341 and a second contact area 342 facing an opposite direction than the first contact area 341.

The first contact arm 41, the second contact arm 42, the first fixed contact member 34, the load terminal 32, the second movable contact member 9, the second fixed contact member 39 and the supply terminal 38 are made of copper. In an alternative embodiment the first contact arm, the second contact arm, the first fixed contact member, the load terminal, the second movable contact member, the second fixed contact member and the supply terminal are made of some other material with high electrical conductivity.

The first movable contact member 4 is adapted to pivot relative to the frame 201 around a first pivoting axis 45 between a first position and a second position. The second movable contact member 9 is adapted to pivot relative to the frame 201 around a second pivoting axis 95 between a first position and a second position. The first pivoting axis 45 and the second pivoting axis 95 are parallel to each other, and spaced apart from each other.

Figure 3:
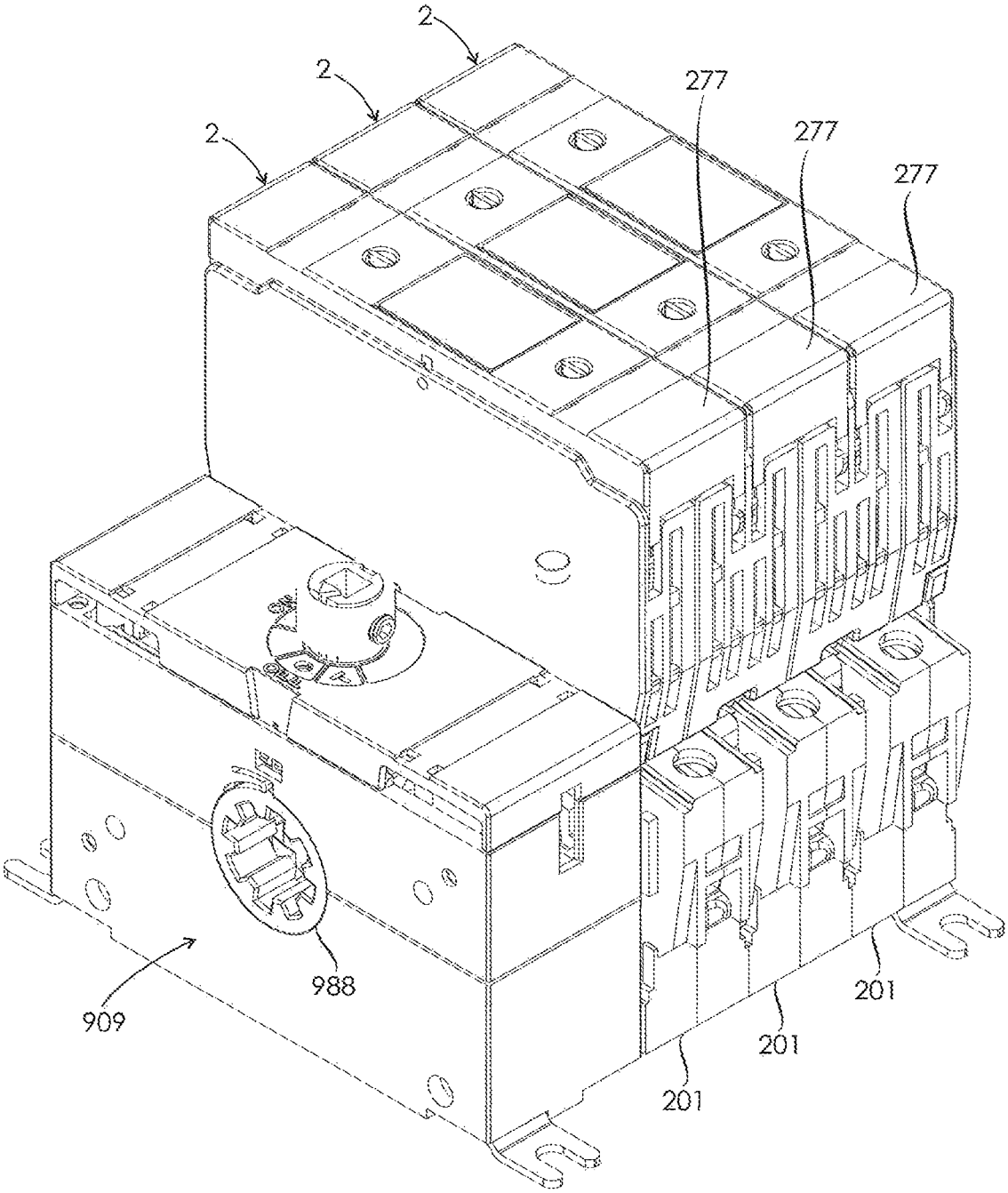
FIG. 3 shows a switching device assembly comprising a control module and three switching devices according to FIG. 1.

FIG. 3 shows a switching device assembly comprising a control module 909 and three switching devices 2 according to FIG. 1. The switching device assembly of FIG. 3 is a three-phase switching device assembly. Each of the switching devices 2 comprises a fuse cover 277 that is omitted from FIGS. 1 and 2. The actuator rolls 8 of the switching devices 2 are connected together, and a control roll 988 of the control module 909 is connected to the actuator roll 8 of one of the switching devices 2 such that the switching devices 2 are adapted to be controlled by the control module 909.

The switching device 2 has an open state and a closed state. A first type switching event is a closing event of the switching device 2 transferring the switching device 2 from the open state to the closed state, or from OFF state to ON state. A second type switching event is an opening event of the switching device 2 transferring the switching device 2 from the closed state to the open state, or from ON state to OFF state.

Figure 4:
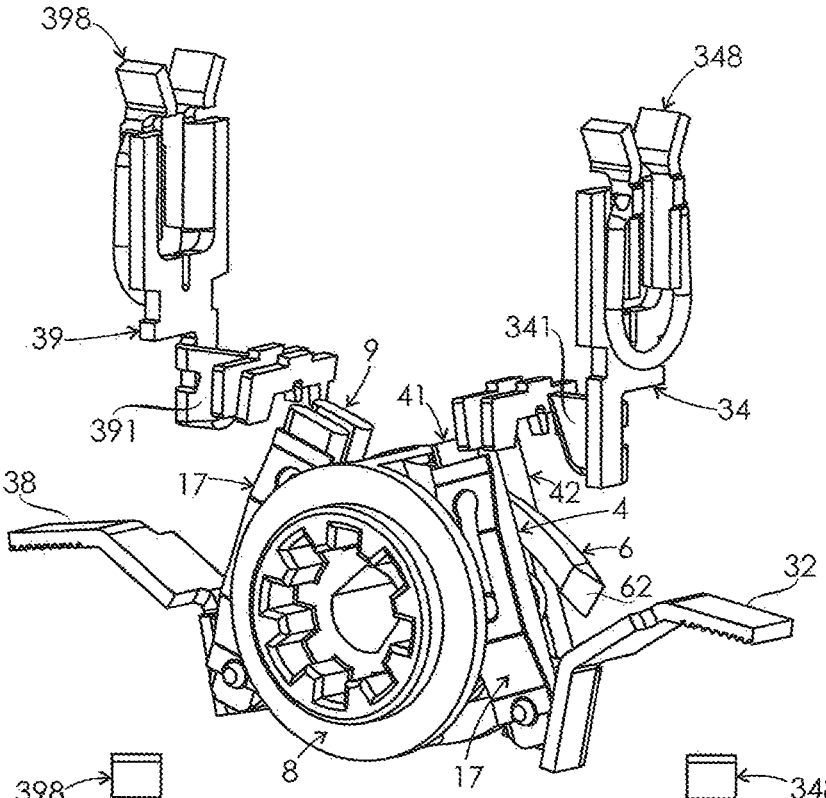
FIGS. 4 and 5 show a mechanism of the switching device of FIG. 1 in an open state of the switching device.
Figure 5:
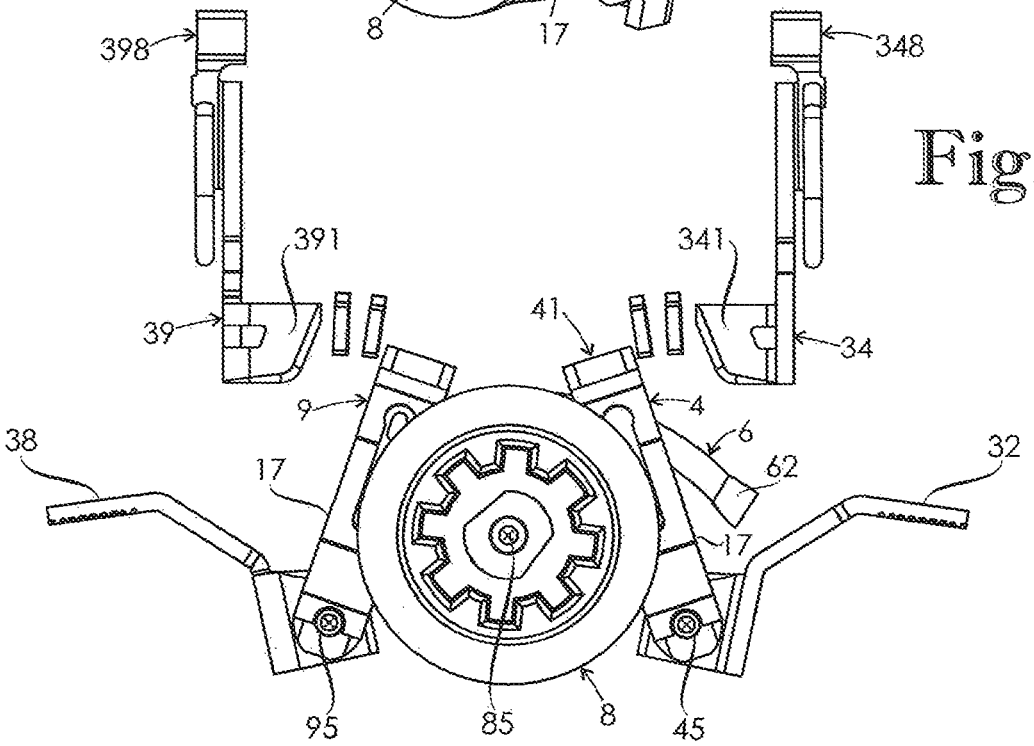

In the open state of the switching device 2, the first movable contact member 4 is in the first position thereof, and the second movable contact member 9 is in the first position thereof. FIGS. 4 and 5 show the mechanism of the switching device 2 in the open state. The frame of the switching device 2 is omitted from FIGS. 4 and 5.

Figure 8A:
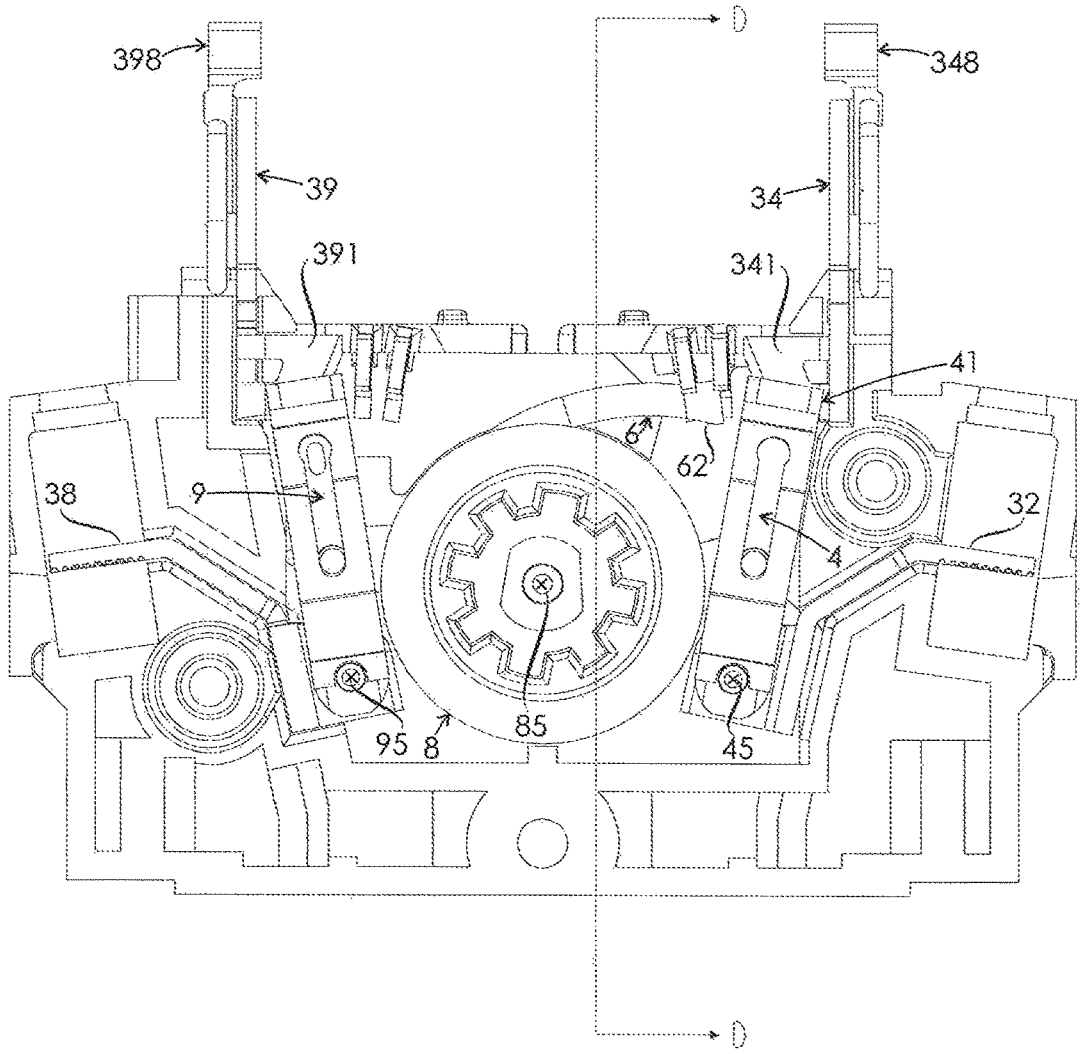
FIG. 8*a* shows the mechanism of the switching device of FIG. 1 in a closed state of the switching device.

In the closed state of the switching device 2, the first movable contact member 4 is in the second position thereof, and the second movable contact member 9 is in the second position thereof. FIG. 8*a* shows the mechanism of the switching device 2 in the closed state. In the closed state, the switching device 2 is adapted to conduct electric current between the supply terminal 38 and the second fixed contact member 39, and between the first fixed contact member 34 and the load terminal 32. In the open state, the switching device 2 is adapted to electrically isolate the supply terminal 38 from the second fixed contact member 39, and the first fixed contact member 34 from the load terminal 32.

In the first position of the first movable contact member 4, a projection of the contact area of the first contact arm 41 is located at a distance from a projection of the first contact area 341 of the first fixed contact member 34 on a switch plane perpendicular to the first pivoting axis 45. In the second position the projection of the contact area of the first contact arm 41 overlaps the projection of the first contact area 341 of the first fixed contact member 34 on the switch plane, and the contact area of the first contact arm 41 is in electrically conductive connection with the first contact area 341 of the first fixed contact member 34, and the first contact arm 41 is in electrically conductive connection with the load terminal 32.

The second contact arm 42 is substantially a mirror image of the first contact arm 41 with respect to a plane perpendicular to the first pivoting axis 45 such that when the first movable contact member 4 is in the second position, the first and second contact areas of the first fixed contact member 34 are located between the contact areas of the first contact arm 41 and the second contact arm 42 in a lateral direction parallel to the first pivoting axis 45. Further, the first movable contact member 4 is symmetrical with respect to a plane perpendicular to the first pivoting axis 45.

In the first position thereof, the second movable contact member 9 is located at a distance from the second fixed contact member 39, and in the second position the second movable contact member 9 is in electrically conductive contact with the second fixed contact member 39, and the second movable contact member 9 is in electrically conductive connection with the supply terminal 38. The second movable contact member 9 is identical to the first movable contact member 4, and the second fixed contact member 39 is identical to the first fixed contact member 34.

The first contact arm 41 is in electrically conductive connection with the load terminal 32 in every position of the first movable contact member 4. The second movable contact member 9 is in electrically conductive connection with the supply terminal 38 in every position of the second movable contact member 9.

In the second position of the first movable contact member 4, the first spring system is adapted to press the contact area of the first contact arm 41 against the first contact area 341 of the first fixed contact member 34 in order to provide the electrically conductive connection between the contact area of the first contact arm 41 and the first contact area 341 of the first fixed contact member 34. Each contact spring 17 of the first spring system is a flat spring. One of the contact springs 17 is in contact with the first contact arm 41. The first spring system is adapted to press the first contact arm 41 and the second contact arm 42 towards each other in the lateral direction.

In an alternative embodiment the first spring system comprises the first contact arm made of flexible material. The flexible first contact arm can be used with or without a separate contact spring.

The spreader member 6 is adapted to provide a first intermediate position for the first movable contact member 4 in which the projection of the contact area of the first contact arm 41 overlaps partially with the projection of the first contact area 341 of the first fixed contact member 34 on the switch plane while the contact area of the first contact arm 41 is spaced apart from the first contact area 341 of the first fixed contact member 34 in the lateral direction. In the first intermediate position of the first movable contact member 4, a projection of the contact area of the second contact arm 42 overlaps partially with the projection of the second contact area 342 of the first fixed contact member 34 on the switch plane while the contact area of the second contact arm 42 is spaced apart from the second contact area 342 of the first fixed contact member 34 in the lateral direction. The first intermediate position is a position between the first position and the second position of the first movable contact member 4.

Herein, the projection of the contact area of the first contact arm overlaps partially with the projection of the first contact area of the first fixed contact member when the overlapping area is at least 30% of a maximum mutual contact area between the first contact area of the first fixed contact member and the contact area of the first contact arm. In an embodiment, the spreader member is adapted to provide a first intermediate position for the first movable contact member in which said overlapping area is 100% of a maximum mutual contact area between the first contact area of the first fixed contact member and the contact area of the first contact arm.

During the first type switching event, the spreader member 6 is adapted to defer contact between the first contact arm 41 and the first fixed contact member 34. The spreader member 6 defers a contact time of the first contact arm 41, and increases a contact angle of the first contact arm 41. The contact time of the first contact arm 41 is a time during the first type switching event when the first contact arm 41 makes contact with the first fixed contact member 34. The contact angle of the first contact arm 41 is an angle of the first contact arm 41 at which the first contact arm 41 makes contact with the first fixed contact member 34. The contact angle of the first contact arm 41 is measured around the first pivoting axis 45 from the first position of the first movable contact member 4 towards the second position of the first movable contact member 4. Therefore, the spreader member 6 is adapted to increase a mutual contact area between the first fixed contact member 34 and the first contact arm 41 at the contact time of the first contact arm 41. Further, due to the symmetry of the first movable contact member 4, the spreader member 6 is adapted to increase a mutual contact area between the first fixed contact member 34 and the second contact arm 42 at the contact time of the second contact arm 42. The contact time of the first contact arm 41 is the same as the contact time of the second contact arm 42, and consequently the spreader member 6 is adapted to increase a mutual contact area between the first fixed contact member 34 and the first movable contact member 4 at a contact time of the first movable contact member 4. The contact time of the first movable contact member 4 is a time during the first type switching event when the first movable contact member 4 makes contact with the first fixed contact member 34.

Figure 7A:
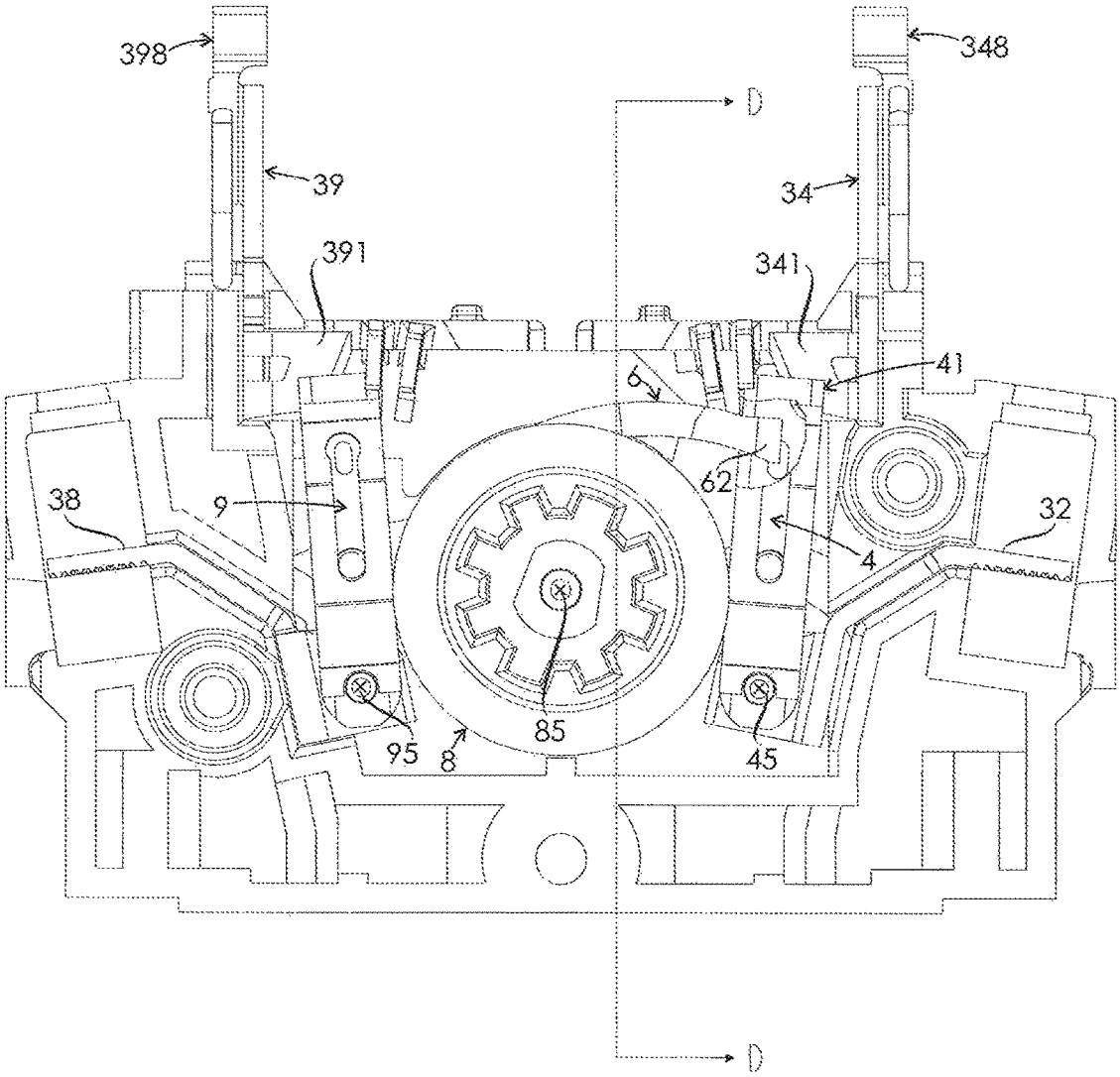
FIG. 7*a* shows the mechanism of the switching device of FIG. 1 in a state in which a first movable contact member of the switching device is in a first intermediate position.

FIG. 7*a* shows the mechanism of the switching device 2 in a state in which the first movable contact member 4 is in the first intermediate position. In the first intermediate position of the first movable contact member 4, the spreader member 6 exerts a first lateral force on the first contact arm 41, the first lateral force acting against a force exerted by the first spring system, and keeping the contact area of the first contact arm 41 in a position laterally spaced apart from the first contact area 341 of the first fixed contact member 34. Further, in the first intermediate position of the first movable contact member 4, the spreader member 6 exerts a first lateral force on the second contact arm 42, the first lateral force acting against a force exerted by the first spring system, and keeping the contact area of the second contact arm 42 in a position laterally spaced apart from the second contact area 342 of the first fixed contact member 34. In other words, in the first intermediate position of the first movable contact member 4, the spreader member 6 spreads the first contact arm 41 and the second contact arm 42 away from each other in the lateral direction. The first lateral force exerted by the spreader member 6 on the first contact arm 41 has the same absolute value as the first lateral force exerted by the spreader member 6 on the second contact arm 41. In FIG. 7*a* the lateral direction is perpendicular to the image plane. In FIG. 7*a*, a portion of the first contact arm 41 and a portion of the contact spring 17 has been cut out in order to show the spreader member 6 between the first contact arm 41 and the second contact arm 42.

Figure 7B:
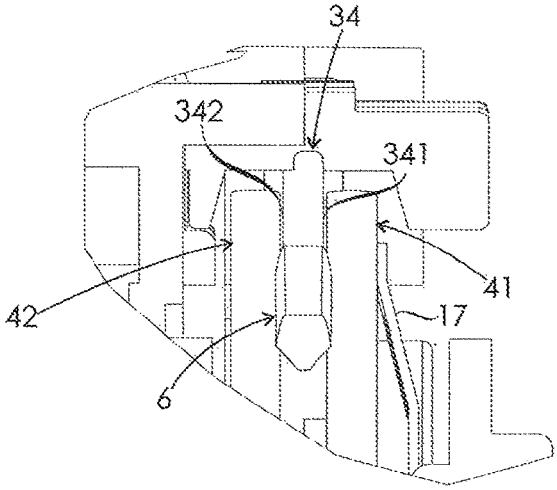
FIG. 7*b* shows a detail of the mechanism of FIG. 7*a*, as seen from a perpendicular direction.

FIG. 7*b* shows a cross section of a detail of the mechanism of FIG. 7*a* taken along line D-D. In FIG. 7*b* the lateral direction of the switching device 2 is a horizontal direction. FIG. 7*b* shows that there is a gap in the lateral direction between the contact area of the first contact arm 41 and the first contact area 341 of the first fixed contact member 34. FIG. 7*b* also shows that there is a gap in the lateral direction between the contact area of the second contact arm 42 and the second contact area 342 of the first fixed contact member 34. Therefore there is no electrically conductive connection between the first movable contact member 4 and the first fixed contact member 34. The gap between the contact area of the first contact arm 41 and the first contact area 341 of the first fixed contact member 34, and the gap between the contact area of the second contact arm 42 and the second contact area 342 of the first fixed contact member 34 are provided by the spreader member 6 located between the first contact arm 41 and the second contact arm 42, and spreading them away from each other.

FIG. 8*a* shows the mechanism of the switching device 2 in the closed state, in which the first movable contact member 4 is in the second position. In the second position of the first movable contact member 4, the spreader member 6 exerts a second lateral force on the first contact arm 41, the second lateral force being smaller than the first lateral force thereby allowing the contact area of the first contact arm 41 to press against the first contact area 341 of the first fixed contact member 34. FIG. 8*a* shows that in the closed state of the switching device 2 the spreader member 6 is spaced apart from the first movable contact member 4, and therefore the second lateral force is zero. In the closed state of the switching device 2 a projection of the spreader member 6 is located at a distance from a projection of the first movable contact member 4 on the switch plane perpendicular to the lateral direction. In FIG. 8*a* the lateral direction is perpendicular to the image plane.

Figure 8B:
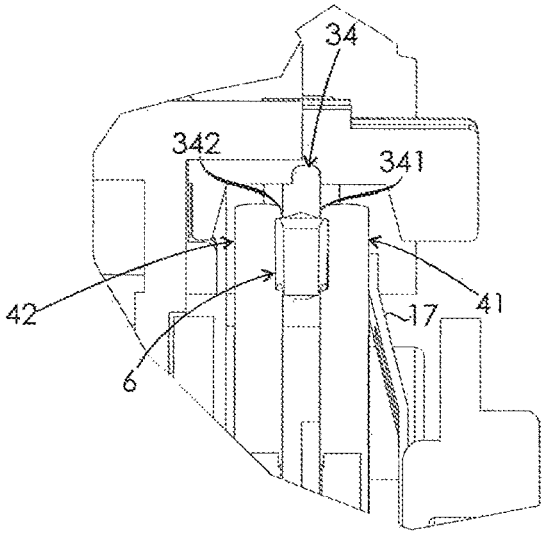
FIG. 8*b* shows a detail of the mechanism of FIG. 8*a*, as seen from a perpendicular direction.

FIG. 8*b* shows a cross section of a detail of the mechanism of FIG. 8*a* taken along line D-D. In FIG. 8*b* the lateral direction of the switching device 2 is a horizontal direction. FIG. 8*b* shows that there is a physical contact between the contact area of the first contact arm 41 and the first contact area 341 of the first fixed contact member 34. FIG. 8*b* also shows that there is a physical contact between the contact area of the second contact arm 42 and the second contact area 342 of the first fixed contact member 34. Therefore there is an electrically conductive connection between the first movable contact member 4 and the first fixed contact member 34.

In the first type switching event, the actuator roll 8 is adapted to rotate relative to the frame 201 around a rotation axis 85 from a first position to a second position, wherein during the first type switching event the actuator roll 8 cooperates with the first movable contact member 4 through a linkage system for pivoting the first movable contact member 4 from the first position of the first movable contact member 4 to the second position of the first movable contact member 4. The linkage system comprises a first linkage arm 804 operationally connecting the actuator roll 8 and the first movable contact member 4, and a second linkage arm 809 operationally connecting the actuator roll 8 and the second movable contact member 9. In the open state of the switching device 2 the actuator roll 8 is in the first position, and in the closed state of the switching device 2 the actuator roll 8 is in the second position.

During the first type switching event the first movable contact member 4 and the second movable contact member 9 pivot in opposite directions. Referring to FIG. 5, during the first type switching event the first movable contact member 4 is pivoting clockwise, and the second movable contact member 9 is pivoting anticlockwise.

The rotation axis 85 of the actuator roll 8 is parallel to the first pivoting axis 45 of the first movable contact member 4, and is spaced apart from it. The rotation axis 85 of the actuator roll 8 is located between the first pivoting axis 45 of the first movable contact member 4 and the second pivoting axis 95 of the second movable contact member 9 in a longitudinal direction of the switching device 2 perpendicular to the lateral direction. In FIGS. 5, 6, 7*a* and 8*a* the longitudinal direction of the switching device 2 is a horizontal direction.

In the second type switching event, the actuator roll 8 is adapted to rotate relative to the frame 201 around the rotation axis 85 from the second position to the first position. Rotation of the actuator roll 8 during the second type switching event is a reverse event compared to rotation of the actuator roll 8 during the first type switching event. During the second type switching event the first movable contact member 4 pivots from the second position of the first movable contact member 4 to the first position of the first movable contact member 4, and the second movable contact member 9 pivots from the second position of the second movable contact member 9 to the first position of the second movable contact member 9.

The spreader member 6 is symmetrical with respect to a plane perpendicular to the first pivoting axis 45. The spreader member 6 has a tapered section 62 adapted to provide a slope for the first contact arm 41 such that during the second type switching event the tapered section 62 cooperates with the first contact arm 41 for transferring the first contact arm 41 in a lateral direction away from the first fixed contact member 34. The tapered section 62 of the spreader member 6 is also adapted to provide a slope for the second contact arm 42 such that during the second type switching event the tapered section 62 cooperates with the second contact arm 42 for transferring the second contact arm 42 in a lateral direction away from the first fixed contact member 34. The tapered section 62 is located at a distance from the rotation axis 85.

A cross section of the tapered section 62 has a shape of a triangle. The point of the tapered section 62 is sharp. The point of the tapered section 62 is a free end of the spreader member 6. The widest portion of the spreader member 6 is located at a base of the tapered section 62. In the first intermediate position of the first movable contact member 4, the widest portion of the spreader member 6 is in contact with the first contact arm 41 and the second contact arm 42. The width direction of the spreader member 6 is parallel to the lateral direction.

The spreader member 6 has a supported end connected to the actuator roll 8. The spreader member 6 is movable relative to the frame 201 between a first position and a second position such that when the first movable contact member 4 is in the first position of the first movable contact member 4, the spreader member 6 is in the first position of the spreader member 6, and when the first movable contact member 4 is in the second position of the first movable contact member 4, the spreader member 6 is in the second position of the spreader member 6. During the first type switching event the spreader member 6 and the contact areas of the first contact arm 41 and second contact arm 42 move in opposite directions in the longitudinal direction. Said opposite movement of the spreader member 6 and the contact areas of the first contact arm 41 and second contact arm 42 further improves short circuit performance of the switching device 2.

The spreader member 6 is an integral part of the actuator roll 8. The spreader member 6 is stationary relative to the actuator roll 8. The spreader member 6 is made of the same plastic material as the actuator roll 8. In an alternative embodiment, the spreader member is made of an electrically non-conductive material different than the material of the actuator roll. In a further alternative embodiment, the spreader member is made of material whose hardness is lower than hardness of material of the first contact arm.

Material of the spreader member 6 has high heat endurance such that the spreader member 6 does not melt, deform or catch fire even in situations where the spreader member 6 comes into contact with the first contact arm 41 after the switching device 2 has conducted a maximum current thereof for a long period of time. In an embodiment the spreader member is made of a material whose hardness in 250° C. temperature is at least 80% of the maximum hardness of the material.

In an alternative embodiment the spreader member is a stationary member relative to the frame. In embodiments where the spreader member is not an integral part of the actuator roll, the spreader member may be made of an electrically conductive material, for example the same material as the first contact arm.

The switching device 2 of FIG. 1 is based on a known switching device such that the only difference is the modified actuator roll. In an embodiment a known switching device is upgraded to a switching device according to present invention by replacing the actuator roll of the known switching device with an actuator roll provided with a spreader member.

In an alternative embodiment the first movable contact member only has one contact arm. In said alternative embodiment the spreader member may be an asymmetrical member.

The switching device 2 shown in FIG. 1 is a switch fuse. The first fixed contact member 34 and the second fixed contact member 39 are adapted to receive a fuse between them such that the fuse provides an electrically conductive connection between the first fixed contact member 34 and the second fixed contact member 39. The first fixed contact member 34 has a first fuse contact 348 adapted to receive a first end of a fuse, and the second fixed contact member 39 has a second fuse contact 398 adapted to receive a second end of the fuse. The fuse is not shown in the Figures.

Figure 6:
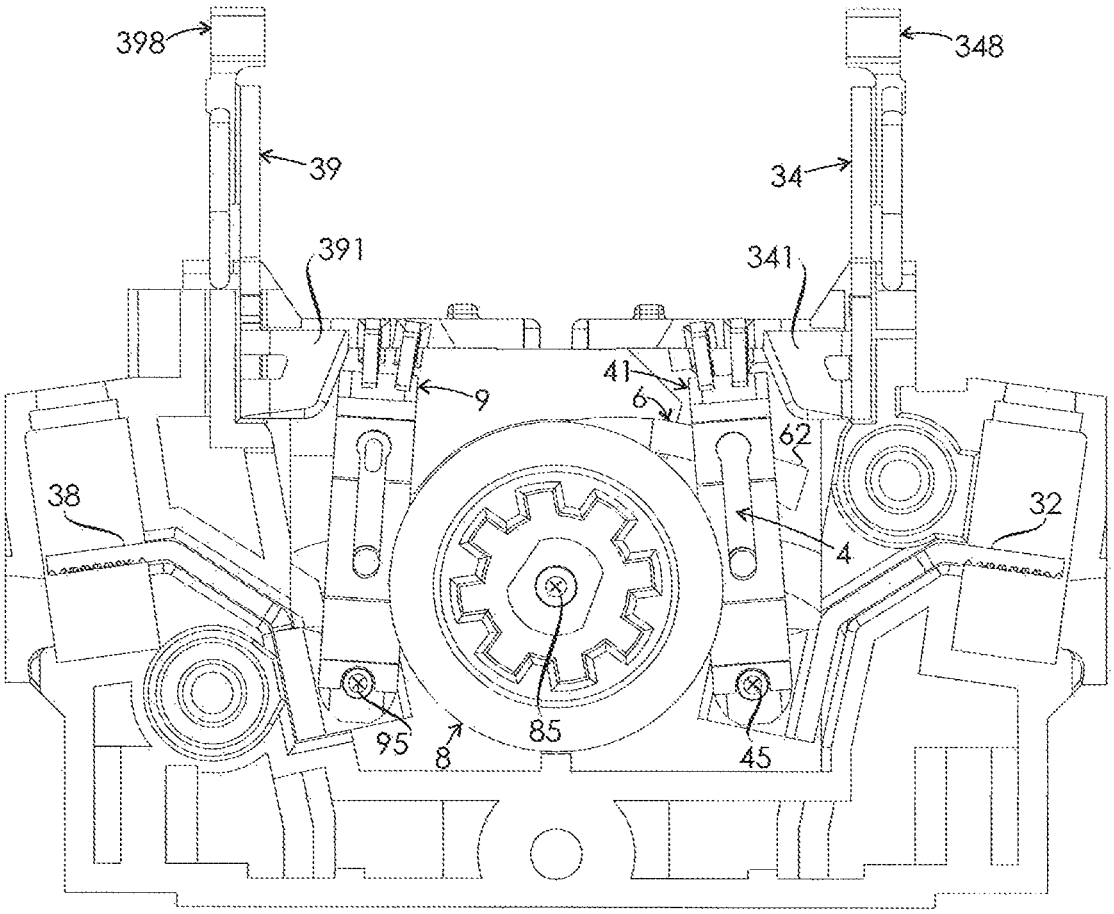
FIG. 6 shows the mechanism of the switching device of FIG. 1 in a state in which a second movable contact member of the switching device makes contact with a second fixed contact member.

During the first type switching event the second movable contact member 9 makes contact with the second fixed contact member 39 before the first movable contact member 4 makes contact with the first fixed contact member 34. FIG. 6 shows the mechanism of the switching device 2 in a state in which the second movable contact member 9 makes contact with the second fixed contact member 39. By the time the first movable contact member 4 makes contact with the first fixed contact member 34, mutual contact area between the second movable contact member 9 and the second fixed contact member 39 has reached its maximum. The switching device 2 is only adapted to electrically conductively connect the supply terminal 38 to the load terminal 32 when both the first movable contact member 4 and the second movable contact member 9 are in electrically conductive connection with the first fixed contact member 34 and the second fixed contact member 39, respectively. Therefore a spreader member is not required to spread contact arms of the second movable contact member 9.

It will be obvious to a person skilled in the art that the inventive concept can be implemented in various ways. The invention and its embodiments are not limited to the examples described above but may vary within the scope of the claims.

The invention claimed is:

1. A switching device comprising:

a frame;

a load terminal adapted to be connected to a load;

a first fixed contact member having a first contact area;

a first movable contact member having a first contact arm provided with a contact area, the first movable contact member being adapted to pivot relative to the frame around a first pivoting axis between a first position in which a projection of the contact area of the first contact arm is located at a distance from a projection of the first contact area of the first fixed contact member on a switch plane perpendicular to the first pivoting axis, and a second position in which the projection of the contact area of the first contact arm overlaps the projection of the first contact area of the first fixed contact member on the switch plane, and the contact area of the first contact arm is in electrically conductive connection with the first contact area of the first fixed contact member, and the first contact arm is in electrically conductive connection with the load terminal; and a first spring system adapted to press the contact area of the first contact arm against the first contact area of the first fixed contact member in the second position of the first movable contact member in order to provide the electrically conductive connection between the contact area of the first contact arm and the first contact area of the first fixed contact member, wherein the switching device comprises a spreader member that is adapted to provide a first intermediate position for the first movable contact member in which the projection of the contact area of the first contact arm overlaps at least partially with the projection of the first contact area of the first fixed contact member on the switch plane while the contact area of the first contact arm is spaced apart from the first contact area of the first fixed contact member, wherein the switching device comprises an actuator roll adapted to rotate relative to the frame in a switching on event around a rotation axis from a first position to a second position, wherein during the switching on event the actuator roll cooperates with the first movable contact member through a linkage system for pivoting the first movable contact member from the first position of the first movable contact member to the second position of the first movable contact member, wherein the actuator roll is adapted to rotate relative to the frame in a switching off event around the rotation axis from the second position to the first position, wherein during the switching off event the actuator roll cooperates with the first movable contact member through the linkage system for pivoting the first movable contact member from the second position of the first movable contact member to the first position of the first movable contact member, wherein the spreader member has a tapered section adapted to provide a slope for the first contact arm such that during the switching off event the tapered section cooperates with the first contact arm for transferring the first contact arm in a lateral direction away from the first fixed contact member, the lateral direction being parallel to the first pivoting axis.

2. The switching device according to claim 1, wherein in the first intermediate position of the first movable contact member the spreader member exerts a first lateral force on the first contact arm, the first lateral force acting against a force exerted by the first spring system, and keeping the contact area of the first contact arm in a position laterally spaced apart from the first contact area of the first fixed contact member, a direction of the first lateral force being parallel to the first pivoting axis, and in the second position of the first movable contact member the spreader member exerts a second lateral force on the first contact arm, the second lateral force being smaller than the first lateral force thereby allowing the contact area of the first contact arm to press against the first contact area of the first fixed contact member.

3. The switching device according to claim 2, wherein the second lateral force is zero.

4. The switching device according to claim 1, wherein the rotation axis of the actuator roll is parallel to the first pivoting axis of the first movable contact member, and is spaced apart from the first pivoting axis of the first movable contact member.

5. The switching device as claimed in claim 1, wherein the first movable contact member has a second contact arm provided with a contact area, and the first fixed contact member has a second contact area facing an opposite direction than the first contact area of the first fixed contact member, wherein the second contact arm is a mirror image of the first contact arm with respect to a plane perpendicular to the first pivoting axis such that when the first movable contact member is in the second position, the first and second contact areas of the first fixed contact member are located between the contact areas of the first contact arm and the second contact arm in the lateral direction parallel to the first pivoting axis.

6. The switching device according to claim 1, wherein the switching device is a switch fuse and comprises:

a supply terminal adapted to be connected to a power supply;

a second fixed contact member having a first contact area;

a second movable contact member having a contact area and adapted to pivot relative to the frame around a second pivoting axis between a first position in which the second movable contact member is located at a distance from the second fixed contact member, and a second position in which the contact area of the second movable contact member is in electrically conductive contact with the first contact area of the second fixed contact member, and the second movable contact member is in electrically conductive connection with the supply terminal, wherein during the switching on event the actuator roll cooperates with the second movable contact member through the linkage system for pivoting the second movable contact member from the first position of the second movable contact member to the second position of the second movable contact member, and the first fixed contact member and the second fixed contact member are adapted to receive a fuse between them such that the fuse provides an electrically conductive connection between the first fixed contact member and the second fixed contact member.

7. The switching device according to claim 6, wherein the second pivoting axis of the second movable contact member is parallel to the rotation axis of the actuator roll, and is spaced apart from both the rotation axis of the actuator roll and the first pivoting axis.

8. The switching device according to claim 6, wherein during the switching on event the second movable contact member makes contact with the second fixed contact member before the first movable contact member makes contact with the first fixed contact member.

9. A switching device comprising:

a frame;

a load terminal adapted to be connected to a load;

a first fixed contact member having a first contact area;

a first movable contact member having a first contact arm provided with a contact area, the first movable contact member being adapted to pivot relative to the frame around a first pivoting axis between a first position in which a projection of the contact area of the first contact arm is located at a distance from a projection of the first contact area of the first fixed contact member on a switch plane perpendicular to the first pivoting axis, and a second position in which the projection of the contact area of the first contact arm overlaps the projection of the first contact area of the first fixed contact member on the switch plane, and the contact area of the first contact arm is in electrically conductive connection with the first contact area of the first fixed contact member, and the first contact arm is in electrically conductive connection with the load terminal; and a first spring system adapted to press the contact area of the first contact arm against the first contact area of the first fixed contact member in the second position of the first movable contact member in order to provide the electrically conductive connection between the contact area of the first contact arm and the first contact area of the first fixed contact member, wherein the switching device comprises a spreader member that is adapted to provide a first intermediate position for the first movable contact member in which the projection of the contact area of the first contact arm overlaps at least partially with the projection of the first contact area of the first fixed contact member on the switch plane while the contact area of the first contact arm is spaced apart from the first contact area of the first fixed contact member, wherein the switching device comprises an actuator roll adapted to rotate relative to the frame in a switching on event around a rotation axis from a first position to a second position, wherein during the switching on event the actuator roll cooperates with the first movable contact member through a linkage system for pivoting the first movable contact member from the first position of the first movable contact member to the second position of the first movable contact member, wherein the spreader member has a supported end connected to the actuator roll, and is movable relative to the frame between a first position and a second position such that when the first movable contact member is in the first position of the first movable contact member, the spreader member is in the first position of the spreader member, and when the first movable contact member is in the second position of the first movable contact member, the spreader member is in the second position of the spreader member, wherein during the switching on event the spreader member and the contact area of the first contact arm move in opposite directions in a longitudinal direction perpendicular to the first pivoting axis.

10. The switching device according to claim 9, wherein the actuator roll is adapted to rotate relative to the frame in a switching off event around the rotation axis from the second position to the first position, wherein during the switching off event the actuator roll cooperates with the first movable contact member through the linkage system for pivoting the first movable contact member from the second position of the first movable contact member to the first position of the first movable contact member.

11. The switching device according to claim 9, wherein the spreader member is an integral part of the actuator roll, and made of the same electrically non-conductive material as the actuator roll.

12. The switching device according to claim 9, wherein in the first intermediate position of the first movable contact member the spreader member exerts a first lateral force on the first contact arm, the first lateral force acting against a force exerted by the first spring system, and keeping the contact area of the first contact arm in a position laterally spaced apart from the first contact area of the first fixed contact member, a direction of the first lateral force being parallel to the first pivoting axis, and in the second position of the first movable contact member the spreader member exerts a second lateral force on the first contact arm, the second lateral force being smaller than the first lateral force thereby allowing the contact area of the first contact arm to press against the first contact area of the first fixed contact member.

13. The switching device according to claim 12, wherein the second lateral force is zero.

14. The switching device according to claim 9, wherein the rotation axis of the actuator roll is parallel to the first pivoting axis of the first movable contact member, and is spaced apart from the first pivoting axis of the first movable contact member.

15. The switching device as claimed in claim 9, wherein the first movable contact member has a second contact arm provided with a contact area, and the first fixed contact member has a second contact area facing an opposite direction than the first contact area of the first fixed contact member, wherein the second contact arm is a mirror image of the first contact arm with respect to a plane perpendicular to the first pivoting axis such that when the first movable contact member is in the second position, the first and second contact areas of the first fixed contact member are located between the contact areas of the first contact arm and the second contact arm in a lateral direction parallel to the first pivoting axis.

16. The switching device according to claim 9, wherein the switching device is a switch fuse and comprises:

a supply terminal adapted to be connected to a power supply;

a second fixed contact member having a first contact area;

a second movable contact member having a contact area and adapted to pivot relative to the frame around a second pivoting axis between a first position in which the second movable contact member is located at a distance from the second fixed contact member, and a second position in which the contact area of the second movable contact member is in electrically conductive contact with the first contact area of the second fixed contact member, and the second movable contact member is in electrically conductive connection with the supply terminal, wherein during the switching on event the actuator roll cooperates with the second movable contact member through the linkage system for pivoting the second movable contact member from the first position of the second movable contact member to the second position of the second movable contact member, and the first fixed contact member and the second fixed contact member are adapted to receive a fuse between them such that the fuse provides an electrically conductive connection between the first fixed contact member and the second fixed contact member.

17. The switching device according to claim 16, wherein during the switching on event the second movable contact member makes contact with the second fixed contact member before the first movable contact member makes contact with the first fixed contact member.

* * * * *